US006250518B1

(12) United States Patent
Thirkettle

(10) Patent No.: US 6,250,518 B1
(45) Date of Patent: Jun. 26, 2001

(54) LIQUID POURING SYSTEM

(75) Inventor: Trevor Albert Thirkettle, 12 Carbethon Crescent, Beverley Hills, New South Wales, 2209 (AU)

(73) Assignees: Trevor Albert Thirkettle; June Lorraine Thirkettle, both of Beverley Hills (AU)

( * ) Notice: Subject to any disclaimer, the term of this patent is extended or adjusted under 35 U.S.C. 154(b) by 0 days.

(21) Appl. No.: 09/533,021

(22) Filed: Mar. 22, 2000

(30) Foreign Application Priority Data

Apr. 20, 1999 (AU) ..... PP9852
Jul. 5, 1999 (AU) ..... PQ1415

(51) Int. Cl.[7] ..... B65D 5/72
(52) U.S. Cl. ..... 222/570; 222/567

(58) Field of Search ..... 222/548, 567, 222/570

(56) References Cited

U.S. PATENT DOCUMENTS 3,726,447 * 4/1973 Klygis ..... 222/570
3,822,812 * 7/1974 Shorin et al. ..... 222/570

* cited by examiner

*Primary Examiner*—Philippe Derakshani
*Assistant Examiner*—Thach H Bui

(57) ABSTRACT

Methods and apparatus are provided for forming a pourer (11, 30) or spout for a liquid container (10). The apparatus comprises an adhesive strip with backing (32). The strip may be pre-formed with features (for example 44, 45, 40, 41, 42) to facilitate use. In the alternative the strip may be formed from conventional materials and made only when required.

12 Claims, 4 Drawing Sheets

LIQUID POURING SYSTEM

FIELD OF THE INVENTION

This invention relates to pouring systems and more particularly to a disposable pourer for liquid containers such as paint cans.

BACKGROUND OF THE INVENTION

Pouring a liquid such as paint from a paint can often fouls the seal and creates spills and drips which require clean-up.

SUMMARY OF THE INVENTION

According to one aspect of the invention there is provided a pourer for a container comprising a strip of material of predetermined dimensions having an adhesive on at least a portion of one side, a cut-out portion in the central region of the strip having a part circular boundary and a backing sheet secured to the strip by he adhesive.

Preferably, the part-circular boundary of the cut-out portion is sized to suit a particular cylindrical container such as a paint pail or can and the remainder of the boundary of the cut-out portion is straight so that the cut-out portion forms a segment of a circle that is slightly smaller than the crosssection section of the paint pail or can.

The strip and backing sheet may be pre-assembled and the cut-out formed by die cutting the composite material.

According to another aspect of the invention there is provided a method of forming a pourer for a can comprising the steps of:

(i) providing a strip of material of predetermined dimensions having an adhesive on at least one portion of one side, (ii) Placing the strip, the adhesive side down, on the open top of the can with the strip off-centre in relation to the can and with a central portion of the strip overlying the edge of the can and side portions of the strip extending outwardly of the can, (iii) folding the side portion upwardly and inwardly so that a part thereof is adhered to the can and other parts thereof are adhered to the central portion of the strip, and (iv) cutting away the portion of the strip inward of the rim to form the pourer.

In one form of the invention, the portion of the strip inwards of the rim is cut into tabs that are secured to the inner face of the rim and the can. The strip may be formed with or without a backing sheet and may be drawn from a roll or be preformed to suit a particular size of can. In the latter case, some or all of the strip destined to be inside the rim of the can may be removed.

Figure 1:
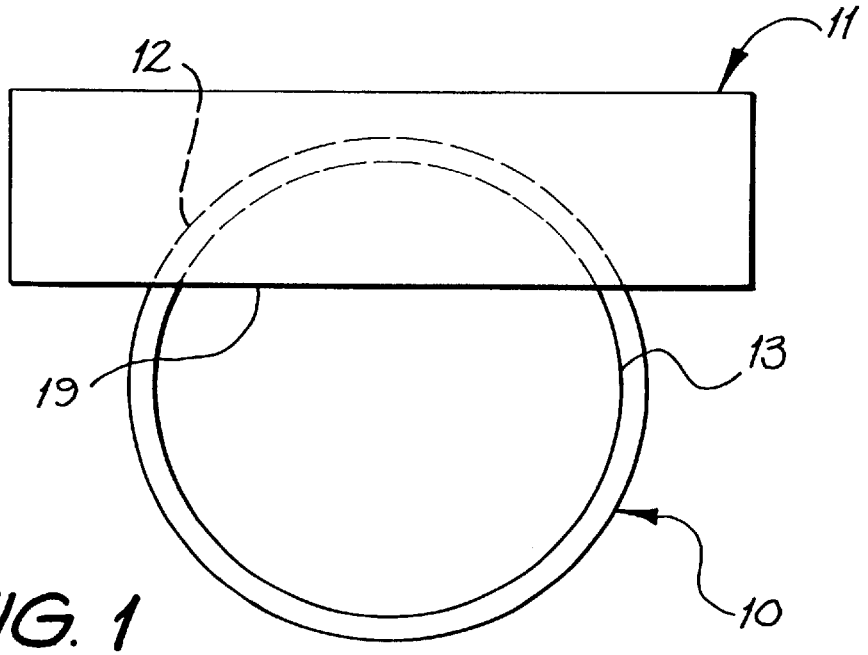
FIG. 1 is a plan view of a paint can showing the first step in forming a disposable pourer according to one embodiment of the invention.

The preferred method of forming a disposable pourer for a liquid container or can 10 shown in FIGS. 1 to 6 commences with the application of a strip 11 of tape having adhesive on one side across the top of the can 10 with the adhesive side downwards. The strip 11 is applied adjacent to one edge 12 of the can—that is offset from the centre of the can 10. The strip 11 may be taken from a roll of tape 8 to 12 cm wide depending upon the diameter of the can to which the spout is to be applied.

In this instance, the tape 11 is positioned on the can 10 so that there is an overhang of 4 to 5 cm at the left of the can 10 and an overhang of about 1.5 to 2 cm in the central portion of the strip at the edge 12. The tape is then cut from the roll (not shown) so that there is a similar overhang of about 4 to 5 cm at the right side of the can 10. The strip 11 is pressed firmly downwards onto the rim by running a finger or solid object around the portion of the strip 11 that overlies the rim 13.

Figure 2:
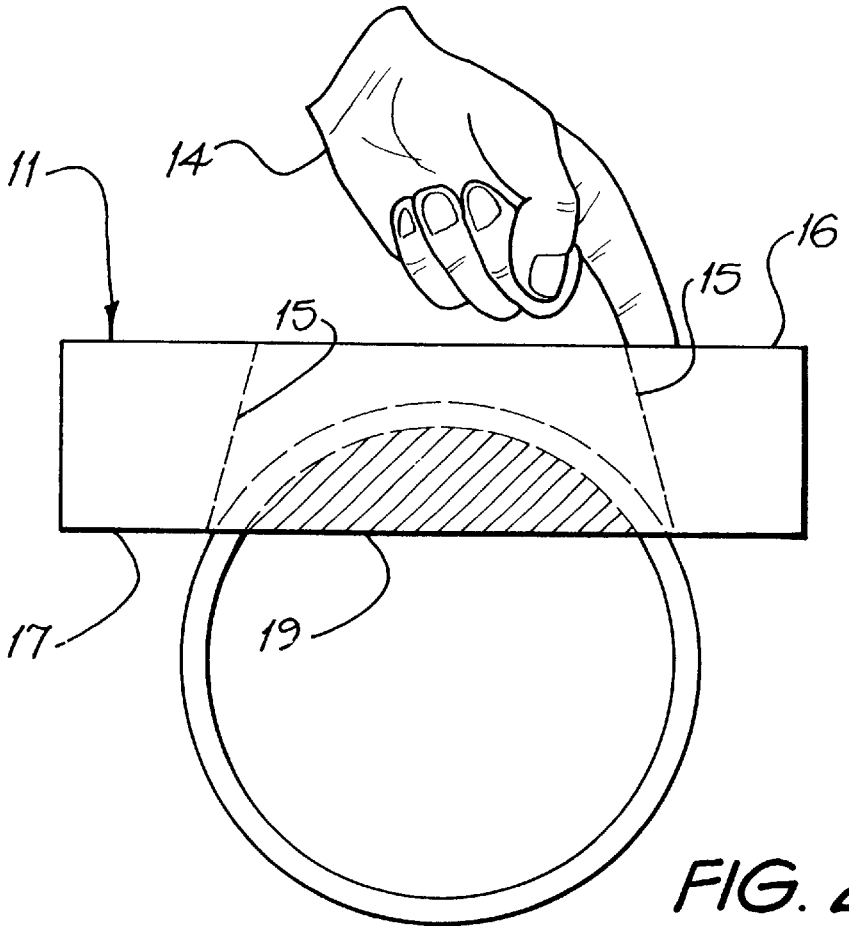
FIG. 2 is a view similar to FIG. 1 showing the second step in forming the disposable pourer.

The next step of the method is shown in FIG. 2 where a finger 14 or an object such as the blade of a screwdriver is placed beneath the strip 11 in the direction of the dotted line 15 which is inclined outwardly from the front edge 16 of the strip 11. As the strip 11 is lifted by the finger 14, the overhanging portion 16 is folded downwardly as shown in FIG. 2 and pressed against the side of the can and the remainder of the overhang is folded against the central portion of the strip adjacent the dotted line 15. This step is repeated on the other overhanging portion 17.

Figure 3:
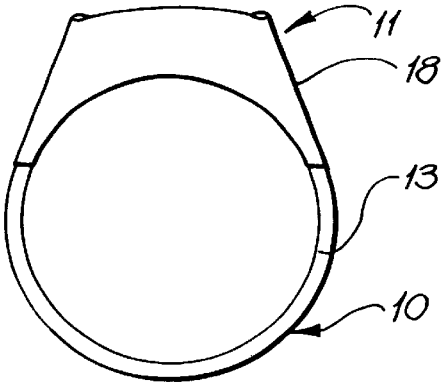
FIG. 3 is a plan view of the formed pourer.
Figure 4:
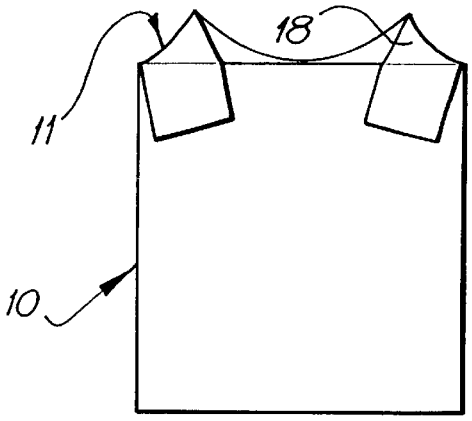
FIG. 4 is a front view of the formed pourer.
Figure 5:
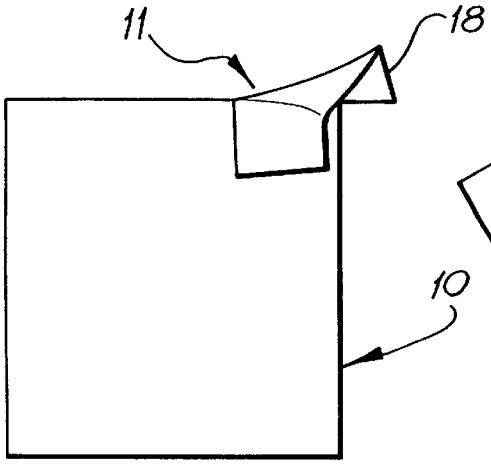
FIG. 5 is a side view of the formed pourer.
Figure 6:
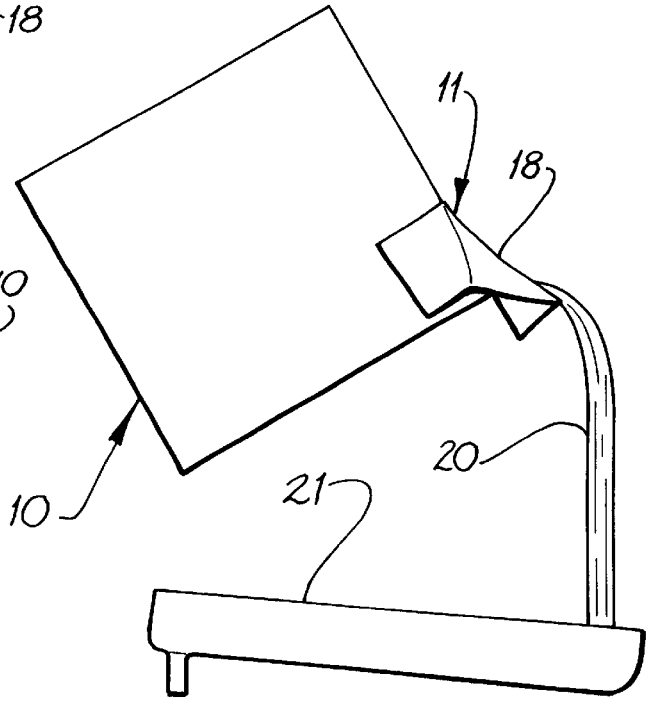
FIG. 6 is a view similar to FIG. 5 showing the pourer in use.

The portion 19 of the strip 11 inwards of the rim 13 is cut away using a sharp knife or razor blade which is run around the inner periphery of the rim 13 to form a pourer 18 as shown in FIGS. 3 to 5. The pourer 18 is shown in use in FIG. 6 where paint 20 is being poured into a paint tray 21.

Figure 7:
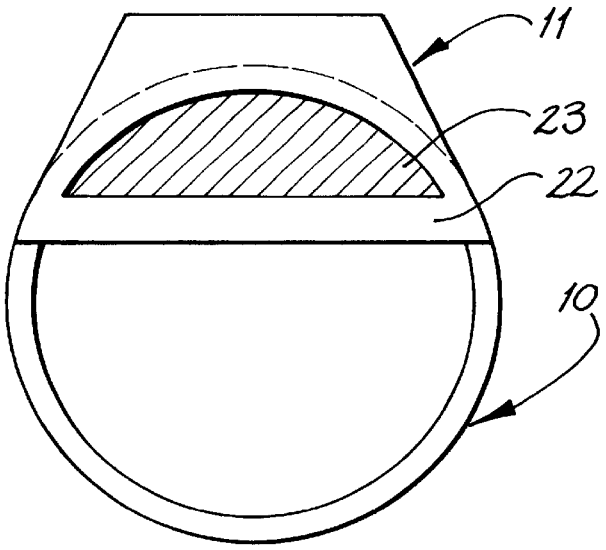
FIG. 7 is a view similar to FIG. 3 showing a disposable pourer according to a second embodiment of the invention.
Figure 8:
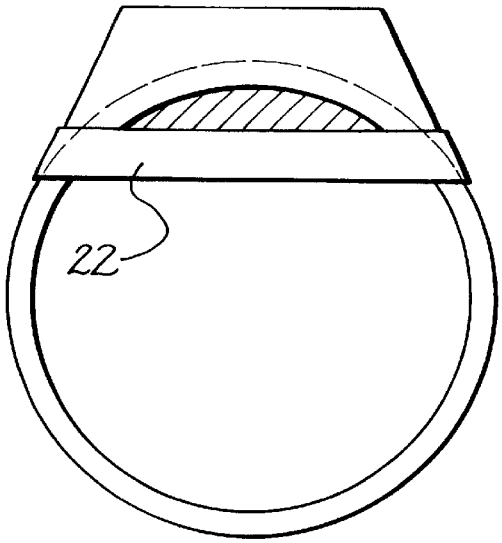
FIG. 8 is a view similar to FIG. 7 showing regulation of the flow of paint.

The strip 11 could be formed from a tape having a backing sheet which is peeled off when the strip 11 is to be applied to the can 10. A portion of the backing sheet 22 can be left on the strip 11 as shown in FIG. 7. The shaded portion 23 of the strip 11 between the rim 13 and the retained backing sheet 22 is removed to form the pourer 18. The flow of paint can be regulated by folding the retained portion 22 having the retained backing sheet thereon towards the edge of the can as shown in FIG. 8.

Figure 9:
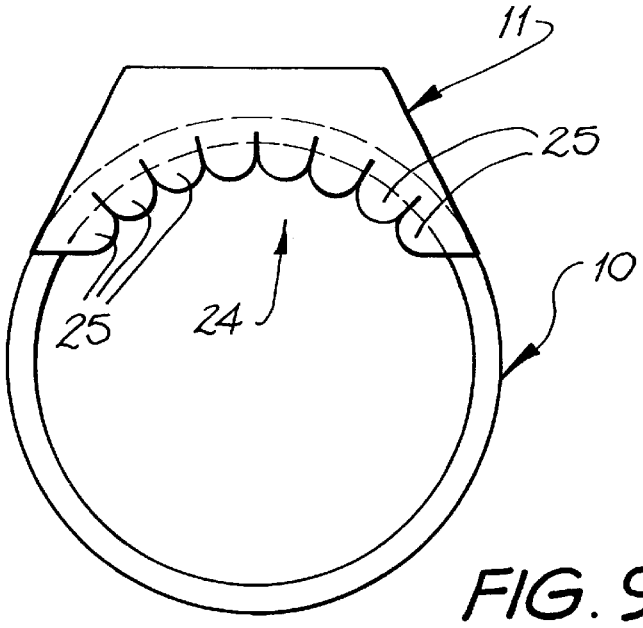
FIG. 9 is a view similar to FIG. 3 showing a disposable pourer according to a third embodiment of the invention.

The method of forming the pourer shown in FIGS. 1 and 2 can be modified as shown in FIG. 9 where a portion of the strip 11 inside the rim 13 is cut radially outwardly every 1 to 1.5 cm and the resultant tabs folded against the inner face of the rim and the can.

The strip 11 may, as indicated above be drawn from a roll of tape with or without a backing sheet. The strip 11 may also be preformed with the portion 19 already removed. Such preformed strips could be supplied as a stack.

Figure 10:
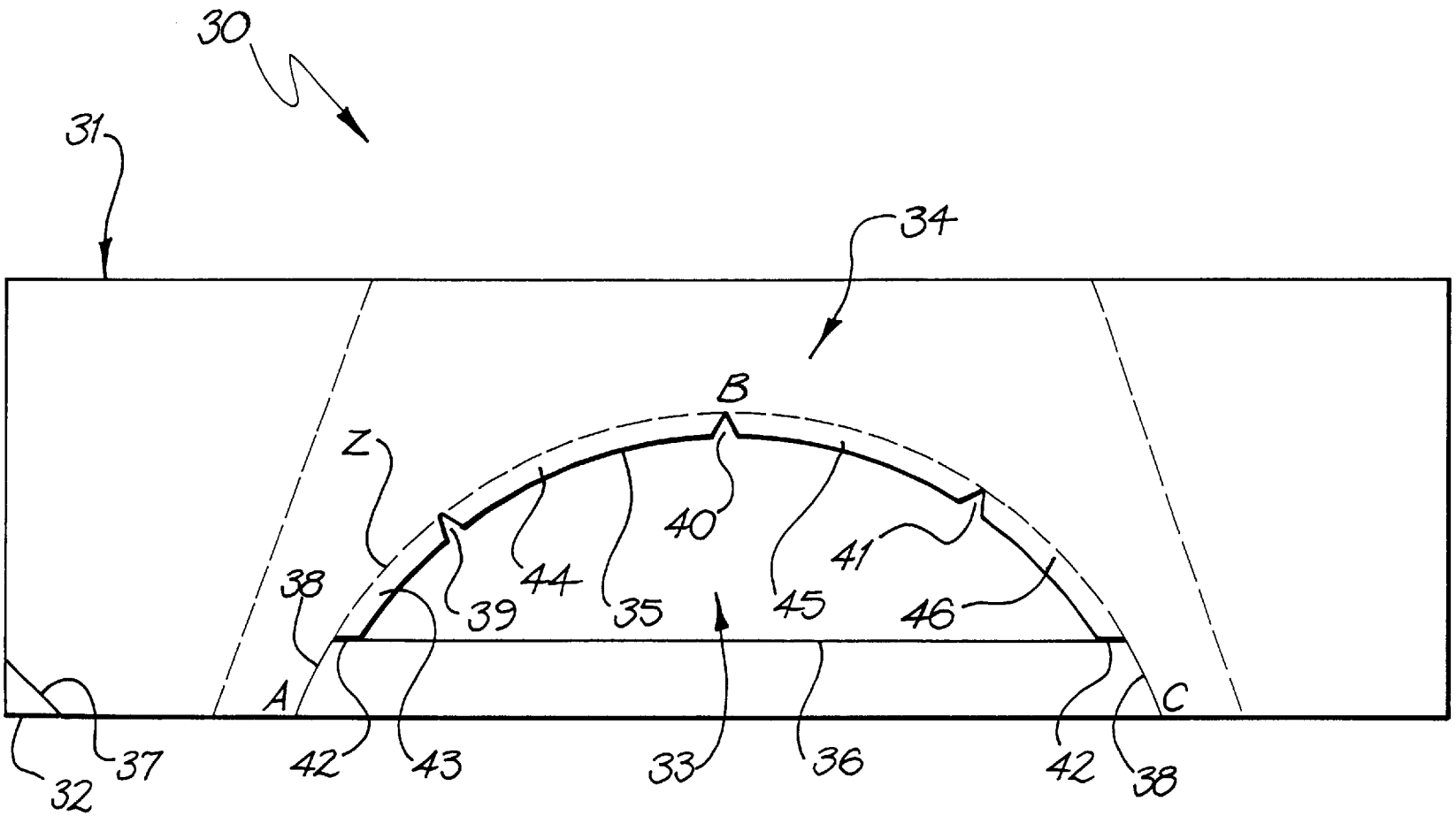
FIG. 10 is a plan view of a paint pourer according to a fourth embodiment of the invention.

The embodiment of the pourer 30 shown in FIG. 10 consists of a composite formed by an upper strip of sheet material 31 having an adhesive on its underside to which is secured a peelable backing sheet 32. The pourer 30 in its prepared form is of generally rectangular shape and has a cut-out portion 33 in its central region 34 formed by any suitable means such as die-cutting.

In this instance, the cut-out portion 33 has an arcuate or part circular boundary 35 and a straight boundary 36 so that the cut-out portion 33 forms a segment of a circle whose radius is slightly smaller than the inner rim or lip radius of a cylindrical paint pail. A portion 37 of the corner of the strip 31 is cut away to facilitate the removal of the strip 31 from the backing sheet 32.

The inner rim of the paint can is indicated by dotted lines Z and two indicating arrows or marks 38 printed on the strip 31 represent the intended location of the inner rim of the pail as it would be located under the strip. Cut-outs 39, 40 and 41 (a) provide visual assistance in locating the part-circular boundary 35 on the rim of the pail and (b) define the fold tabs 43, 44, 45 and 46, and (c) define the depth of a fold when the tabs are folded down below the rim . Line cuts 42 are formed at the junction of the part-circular boundary 35 and the straight boundary 36. Thus, the part-circular periphery of the cut-out 33 is constituted by four foldable tabs or portions 43, 44, 45 and 46.

The strip or its backing may be printed with instructions for use. The first step in using the pourer of FIG. 10 is to remove the backing sheet 32 and place the strip 31 on the open top of the pail after aligning the strip by ensuring points A. B & C are on the rim of the pail. The four tabs or portions 43, 44, 45 an 46 are then folded down and secured to the inner periphery of the rim. The pourer is then formed in the manner described above. Pre-printed dotted lines (as shown in FIG. 10) form converging markings for indicating the orientation of the folds which define the spout.

It will be appreciated that the invention has been disclosed with reference to a particular application (a paint can) but that the invention may be used advantageously with other containers for liquids or even solid powders, flakes or granules. Various other modifications may be made in shape, construction and mode of formation without departing from the scope and ambit of the invention.

I claim:

1. A pouring apparatus for a container comprising:

a strip of material of predetermined dimensions having an adhesive on at least a portion of one side, a cut-out portion in the central region of the strip having an internal arcuate boundary and;

a backing sheet secured to the strip by adhesive.

2. The apparatus of claim 1, wherein:

the arcuate boundary of the cut-out portion is sized to suit a particular cylindrical container such as a paint pail or can and the remainder of the boundary of the cut-out portion is straight so that the cut-out portion forms a segment of a circle whose radius is slightly smaller than the radius of the inner rim of the container.

3. The apparatus of claim 1, wherein:

the strip and backing sheet are pre-assembled as a composite then formed by die cutting the composite.

4. The apparatus of claim 1, wherein:

the arcuate boundary is sub-divided into tabs.

5. The apparatus of claim 1, wherein:

marks are printed on the strip and represent the intended location of an inner rim of the pail as it would be located in use under the strip.

6. The apparatus of claim 1, wherein:

the strip is printed with fold lines which define the spout.

7. The apparatus of claim 6, wherein:

the fold lines converge.

8. The apparatus of claim 1, wherein:

a plurality of similar strips are provided on a roll.

9. A method of forming a pourer for a can comprising the steps of:

(i) providing a strip of material of predetermined dimensions having an adhesive on at least one portion of one side, (ii) placing the strip, the adhesive side down, on the open top of the can with the strip off-centre in relation to the can and with a central portion of the strip overlying the edge of the can and side portions of the strip extending outwardly of the can, (iii) folding the side portion upwardly and inwardly so that a part thereof is adhered to the can and other parts thereof are adhered to the central portion of the strip, and (iv) cutting away the portion of the strip inward of the rim to form the pourer.

10. The method of claim 9, wherein:

the portion of the strip inwards of the rim is cut into tabs that are secured to the inner face of the rim and the can.

11. The method of claim 9, wherein:

the strip may be formed with a backing sheet.

12. The method of claim 9, wherein:

the strip is drawn from a roll.

* * * * *